US006881013B2

(12) United States Patent
Otsuka et al.

(10) Patent No.: US 6,881,013 B2
(45) Date of Patent: Apr. 19, 2005

(54) SAND PILE DRIVING METHOD

(75) Inventors: Makoto Otsuka, Gifu-ken (JP); Osamu Ishida, Ibaraki-ken (JP); Hiroki Yoshitomi, Kamagaya (JP)

(73) Assignee: Fudo Construction Co., Ltd., Osaka (JP)

( * ) Notice: Subject to any disclaimer, the term of this patent is extended or adjusted under 35 U.S.C. 154(b) by 0 days.

(21) Appl. No.: 10/624,930

(22) Filed: Jul. 21, 2003

(65) Prior Publication Data

US 2004/0258486 A1 Dec. 23, 2004

(30) Foreign Application Priority Data

Jun. 19, 2003 (JP) ..... P2003-174400
Jun. 19, 2003 (JP) ..... P2003-174402

(51) Int. Cl.[7] ..... E02D 3/10
(52) U.S. Cl. ..... 405/232; 405/50; 405/248
(58) Field of Search ..... 405/229, 231, 405/232, 50, 248

(56) References Cited

U.S. PATENT DOCUMENTS 3,772,892 A * 11/1973 Ogawa ..... 405/171
4,487,524 A 12/1984 Shono et al.

FOREIGN PATENT DOCUMENTS

| | | | |
|---|---|---|---|
| JP | 58-050216 | 3/1983 | |
| JP | 58-164814 | 9/1983 | |
| JP | 06-200520 | 7/1994 | |
| JP | 07207653 A * | 8/1995 | ..... E02D/03/10 |
| JP | 08-284146 | 10/1996 | |

* cited by examiner

*Primary Examiner*—John Kreck
(74) *Attorney, Agent, or Firm*—Brenda O. Holmes; Kilpatrick Stockton LLP

(57) ABSTRACT

A sand pile driving method for making a sand pile which does not cause trouble in terms of strength even at a soft point in the actual ground, and enables secure limitation of the increase in total construction time and total amount of sand. A compaction procedure is a procedure for compacting a granule pile 15 by pressing and rotating the casing pipe 13 downward. This is performed based on thrust force P by which the casing pipe presses a granule pile and a driving torque T for rotating the casing pipe against a granule pile.

13 Claims, 12 Drawing Sheets

SAND PILE DRIVING METHOD

BACKGROUND OF THE INVENTION

1. Field of the Invention

The present invention relates to a sand pile driving method for driving piles made of sand and the like in a ground for ground improvement.

2. Description of the Related Art

As a method to improve soft soil and the like, a sand compaction pile method (SCP method) for ground improvement, by which sand piles are driven in places in an area to be improved is conventionally known. Description will be given on the conventional sand pile driving method by the sand compaction pile method.

As shown in FIG. 1, a sand pile driving apparatus 1 includes a casing pipe 2 which is disposed in the vertical direction toward a main body of an unillustrated construction machine; a vibrator 3 which vibrates the casing pipe 2; a compaction member 4 which is located at the lower end of the casing pipe 2; and a piston cylinder mechanism 5 which enables the compaction member 4 to perform a reciprocating motion in the vertical direction.

Sand pile driving work by use of the sand pile driving apparatus 1 will be described. By the operation of the vibrator 3, the casing pipe 2 is penetrated into a ground 6 to a predetermined depth. Then, while reciprocating the piston cylinder mechanism 5, sand is discharged from the lower end of the casing pipe 2 and the discharged sand is compacted. At the same time, a pull out procedure to pull out the casing pipe 2 to a predetermined length is performed. By this pull out procedure, sand is filled into a space within the ground 6 which is made after the casing pipe 2 is pulled out.

the reciprocating operation is stopped and sand is resupplied into the casing pipe 2. Then, a procedure to pull out the casing pipe 2 upward is performed again. In this pull out procedure, sand is discharged and compacted while the piston cylinder mechanism 5 performs a reciprocating action. Hereafter, by performing compaction during the pull out procedure of the casing pipe 2 until the lower end thereof reaches the ground surface, a sand pile 7 as shown in FIG. 2A is driven in the space where the casing pipe 2 was penetrated. Such sand piles 7 are driven at adequate intervals.

In general, the strength of the actual ground 6 to be improved is not uniform and scattered in distribution. Therefore, a method that enables changing of one or both of the diameter and strength of the sand pile 7 in accordance to the strength of the ground 6 has been proposed by the inventor.

The prior proposals by the inventor are disclosed in the Japanese Patent Number 136138 and Number 1521542. For example, in a case where only the diameter of the sand pile 7 is changed, thrust force of the piston cylinder mechanism 5 which presses the sand pile 7 downward in the process of compaction is detected and the sand pile 7 is pressed until the thrust force reaches a given preset value. At an area of soft soil of the actual ground 6 in a depth, the sand pile 7 is subjected to compressive deformation in the direction of enlarging the diameter. Then, the thrust force reaches a given preset value and a sand pile 7 with a large diameter is driven.

At a hard ground area of the actual ground 6 in a depth, the thrust force reaches a given preset value before the diameter of the sand pile 7 is not enlarged enough. Thus, sand pile 7 which has a relatively small diameter is driven.

In this way, uniform ground improvement, by reinforcing the ground in accordance with the softness of the actual ground, is realized by making sand piles 7 which are pressed by constant thrust force of the piston cylinder mechanism 5 in the process of compaction.

SUMMARY OF THE INVENTION

In the conventional sand pile driving method, a sand pile 7 is driven by simply pressing from above with a piston cylinder mechanism 5. However, the sand pile 7 is not always securely compacted by pressure from above alone. That is, it is not always guaranteed that the sand piles 7 of the same strength are always driven even by the same thrust force. In addition, only the thrust force of the piston cylinder mechanism 5 is regarded as information for evaluating the compaction condition of the sand pile 7, in other words, the strength of the sand pile 7. Therefore, according to the conventional method, there are cases in which a pile with the desired strength was not driven.

According to the first technical aspect of the present invention, after the initial penetration procedure where a casing pipe is penetrated into the ground to a given depth, a pull out procedure of pulling out the casing pipe while discharging granule from the lower end of the casing pipe, and a compaction procedure of compacting granule that are discharged from the repenetrating casing pipe, are repeated alternately in the sand pile driving method which drives granule piles in the ground. A sand pile driving method is provided with a compaction procedure which is a procedure for compacting granule piles by pressing downward and rotational motion of the casing pipe. Further, the compaction time is adjusted according to the driving torque for rotating the casing pipe against the granule pile. Such a sand pile driving method will be provided.

According to the second technical aspect of the present invention, after the initial penetration procedure where a casing pipe is penetrated into the ground to a given depth, a pull out procedure of pulling out the casing pipe while discharging granule from the lower end of the casing pipe, and a compaction procedure of compacting granule that are discharged from the repenetrating casing pipe, are repeated alternately in the sand pile driving method which drives granule piles in the ground. A sand pile driving method is provided with a compaction procedure which is a procedure for compacting granule piles by pressing downward and rotational motion of the casing pipe. Further, when the compaction condition which is calculated according to the driving torque for rotational motion of the casing pipe against the granule pile and the thrust pressure which presses the granule pile, reaches the given state, the compaction is completed. Such a sand pile driving method will be provided.

In the conventional sand pile driving method, when the actual ground 6 is of very soft soil, the diameter of the sand pile 7 becomes too large before the thrust force of the piston cylinder mechanism 5 reaches a given preset value, thus making a large diameter sand pile 8 as shown in FIG. 2B. In the worst case, the thrust force of the piston cylinder mechanism 5 does not reach the given preset value and work must be suspended. Due to the above-mentioned circumstances, the total working hours and the total amount of sand are increased, thus raising the construction cost. Especially, at a point where no surrounding sand pile 7 is driven, as at the beginning of a construction work, there was a high possibility that the aforementioned problems would arise.

According to the third technical aspect of the present invention, after the initial penetration procedure where a casing pipe is penetrated into the ground to a given depth, a pull out procedure of pulling out the casing pipe while discharging granule from the lower end of the casing pipe, and a compaction procedure of compacting granule that are discharged from the repenetrating casing pipe, are repeated alternately in the sand pile driving method which drives granule piles in the ground. A sand pile driving method is provided with a compaction procedure which is a procedure for compacting granule piles by pressing downward and rotational motion of the casing pipe. A sand pile driving method is provided with a compaction procedure which continuously calculates the compaction condition of the granule compacted by the casing pipe and the cross-sectional area of the granule pile compacted by the casing pipe. When the compaction condition reaches a predetermined condition before the cross-sectional area of the granule reaches the minimum pile cross-sectional area by the compaction of the casing pipe, the compaction is completed at the point when the cross-sectional area of the granule reaches the minimum cross-sectional area. When the compaction condition reaches a predetermined condition before the cross-sectional area of the granule reaches the maximum pile cross-sectional area by the compaction of the casing pipe, the compaction is completed at that point. When the cross-sectional area of the granule reaches the maximum cross-sectional area by the compaction of the casing pipe before the compaction condition reaches a predetermined condition, the compaction is completed at the point when the cross-sectional area of the granule reaches the maximum cross-sectional area. Such a sand pile driving method is to be provided.

In addition, in the conventional sand pile driving method, it was difficult to obtain enough strength when the ground 6 was very soft, or significant displacement was caused by localization of strength between areas where the sand piles had already been driven and those where they had not yet been driven during the sand pile driving procedure.

According to the fourth technical aspect of the present invention, after the initial penetration procedure where a casing pipe is penetrated into the ground to a given depth, a pull out procedure of pulling out the casing pipe while discharging granule from the lower end of the casing pipe, and a compaction procedure of compacting granule that are discharged from the repenetrating casing pipe, are repeated alternately in the sand pile driving method which drives granule piles in the ground. This sand pile driving method is provided with a compaction procedure which is a procedure for compacting granule piles by pressing downward and rotational motion of the casing pipe. The compaction procedure consists of (1) a first step to drive a first plurality of piles in a given area and (2) a second step to further drive a second plurality of piles between the first plurality of piles driven in the area. Furthermore, in the compaction procedure for at least one of the first plurality of piles, compaction time is arranged in accordance with the thrust force of the casing pipe for pressing the granule and the driving torque for rotational motion of the casing pipe against the granule pile. Such a sand pile driving method is to be provided.

DESCRIPTION OF THE PREFERRED EMBODIMENT

Figure 1:
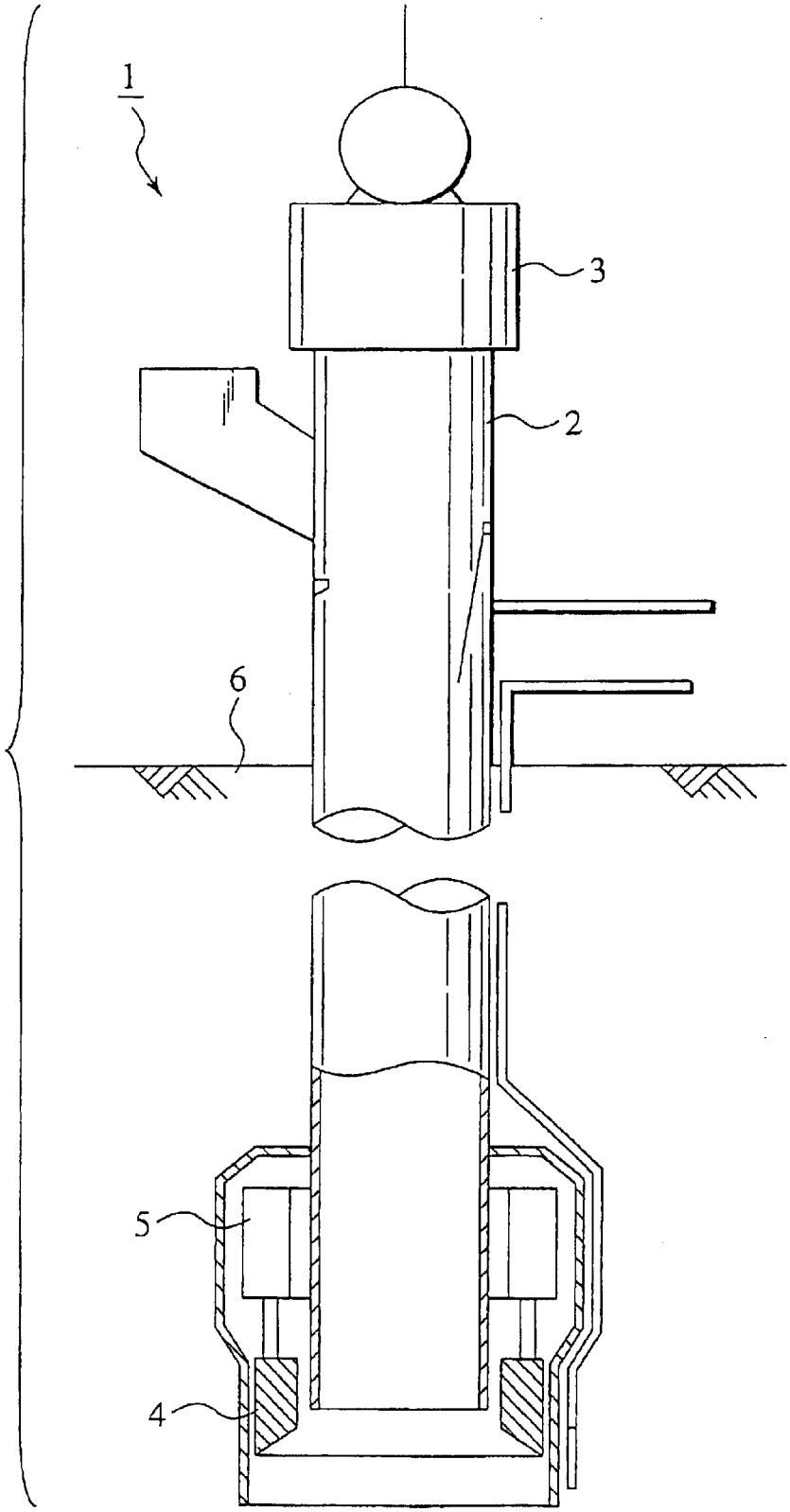
FIG.1 PRIOR ART
FIG. 1 is a block diagram showing substantial parts of a sand pile driving apparatus of a conventional example.
Figure 2A:
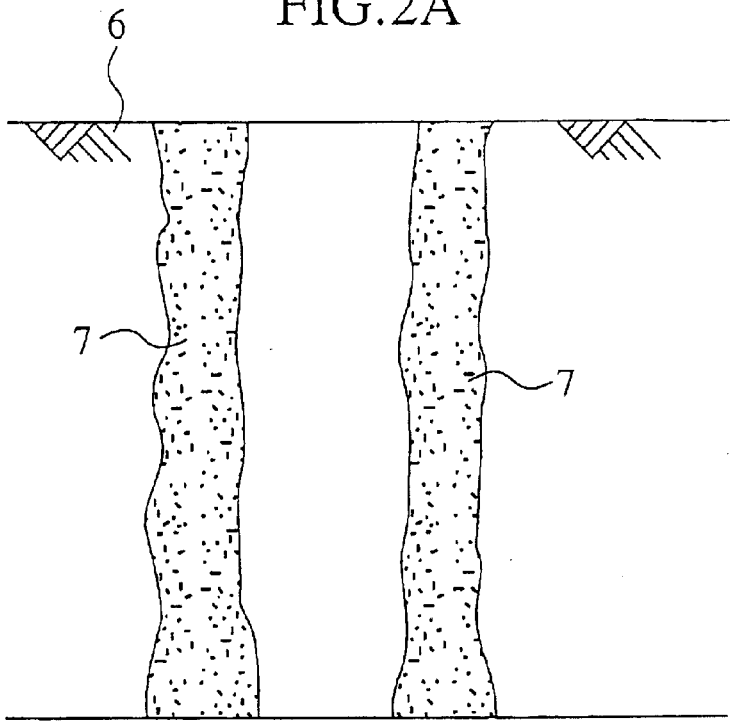
FIG. 2A is a cross-sectional view showing a sand pile driven in the ground and FIG. 2B shows sectional views of a sand pile driven in very soft soil and a sand pile with a typical diameter.
Figure 2B:
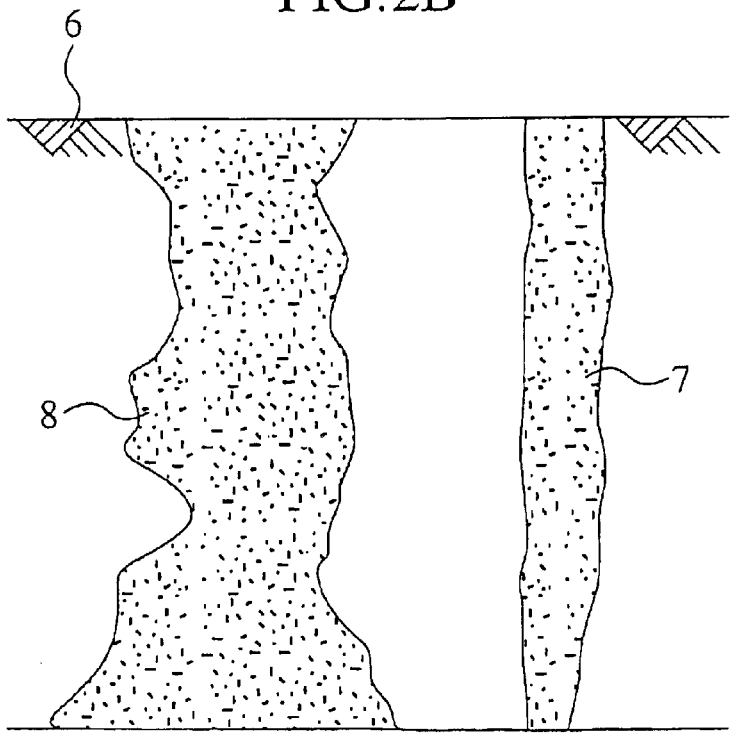
Figure 3:
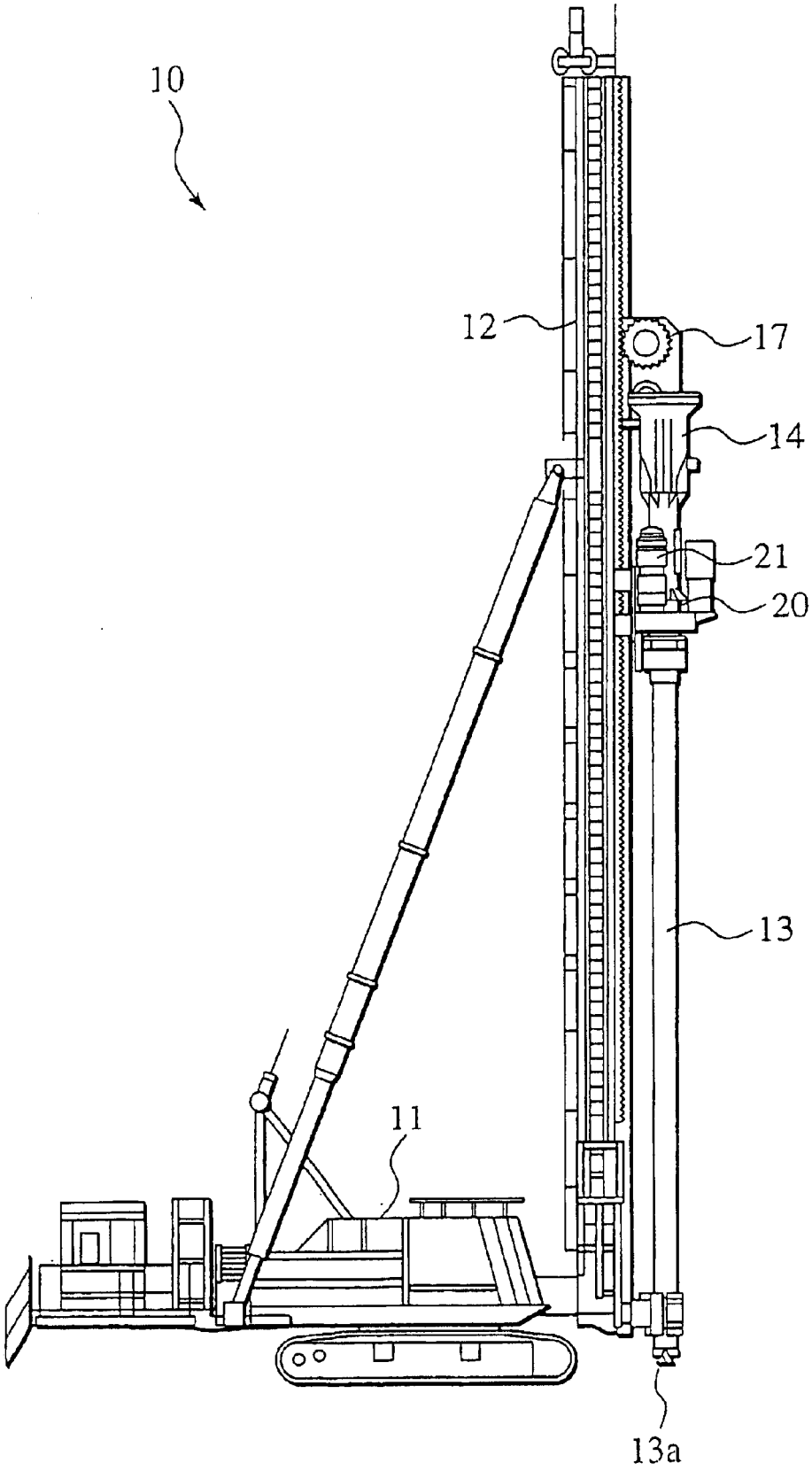
FIG. 3 is a side view of a sand pile driving apparatus according to the present invention.
Figure 4A:
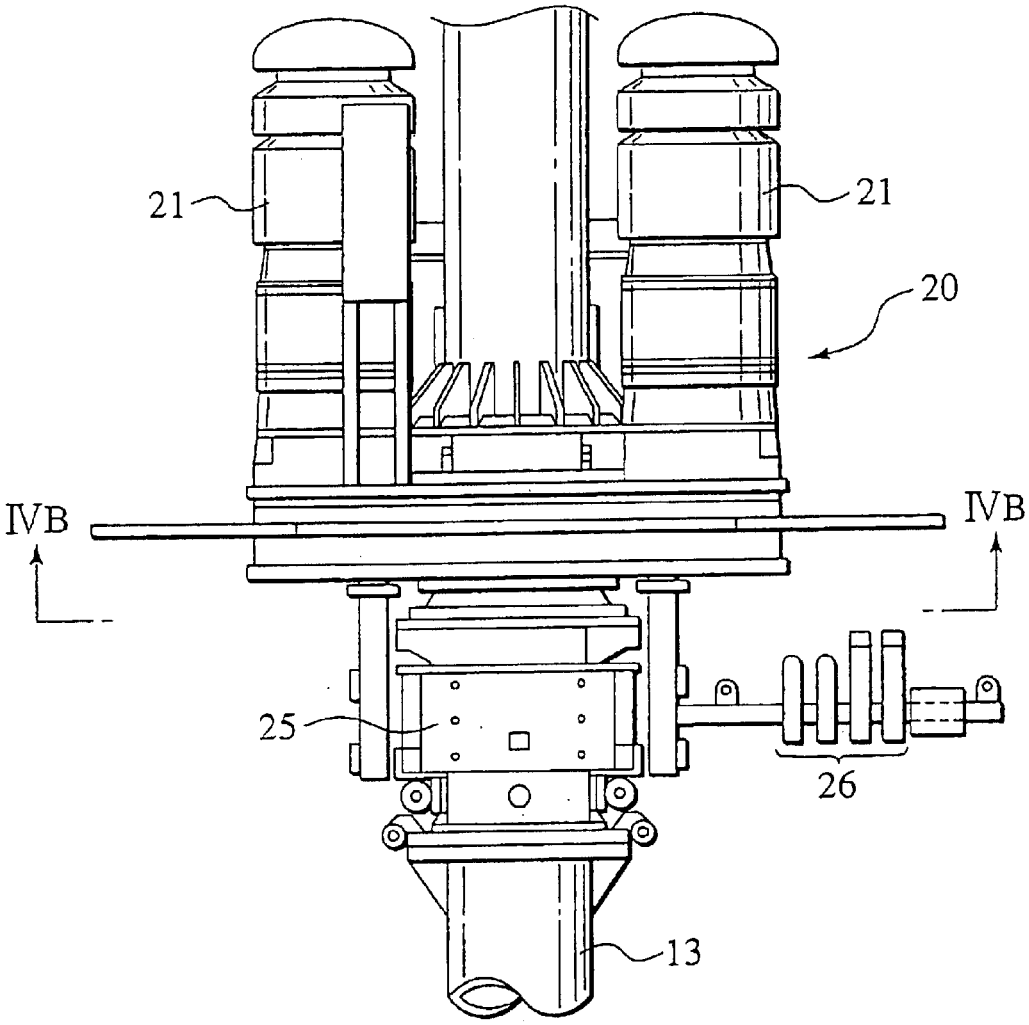
FIG. 4A is a front view of a rotational mechanism of the sand pile driving apparatus according to the present invention and FIG. 4B is a cross-sectional view taken along line IVB—IVB in FIG. 4A.
Figure 4B:
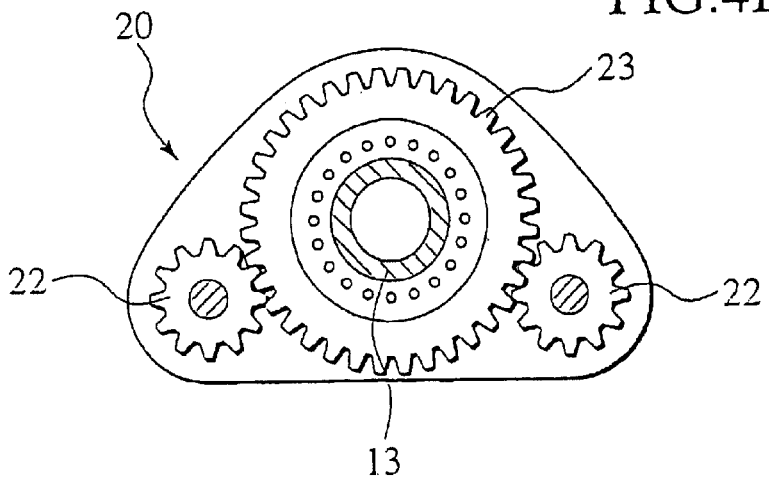
Figure 5:
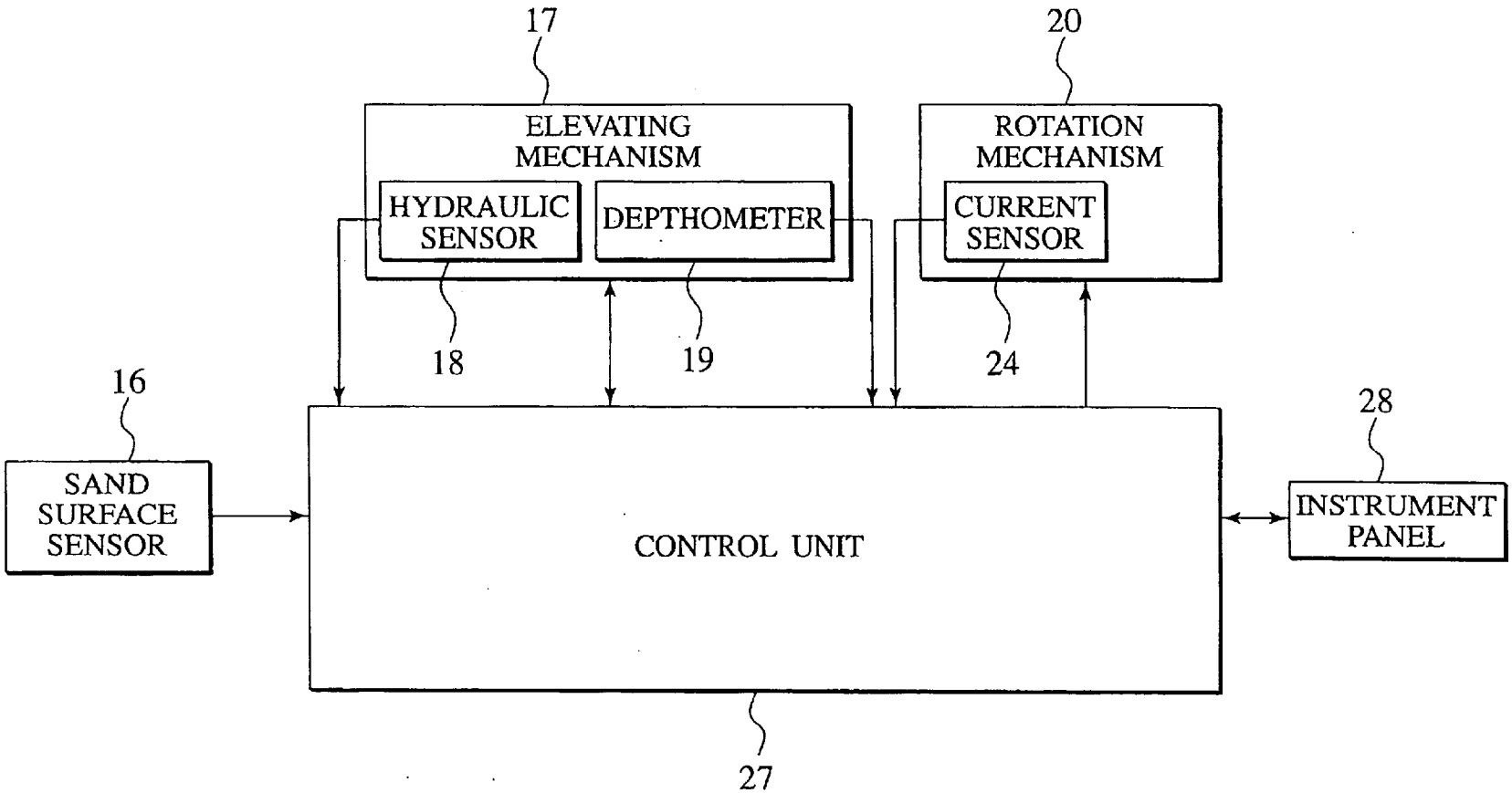
FIG. 5 is a block diagram of a main circuit of a control system of a sand pile driving apparatus according to the present invention.
Figure 6:
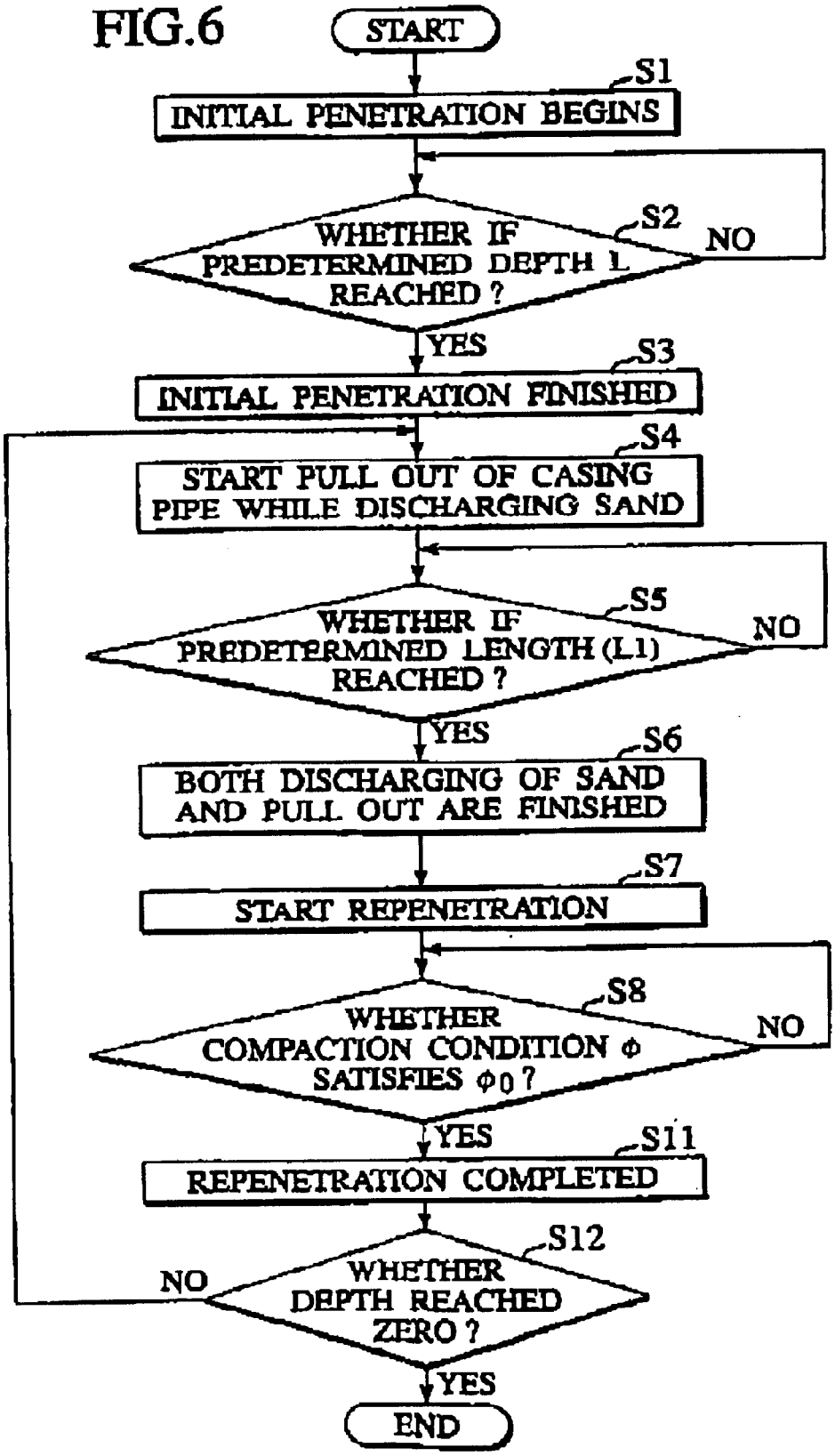
FIG. 6 is a flow chart in respect with driving a sand pile according to a first embodiment of the present invention.
Figure 7:
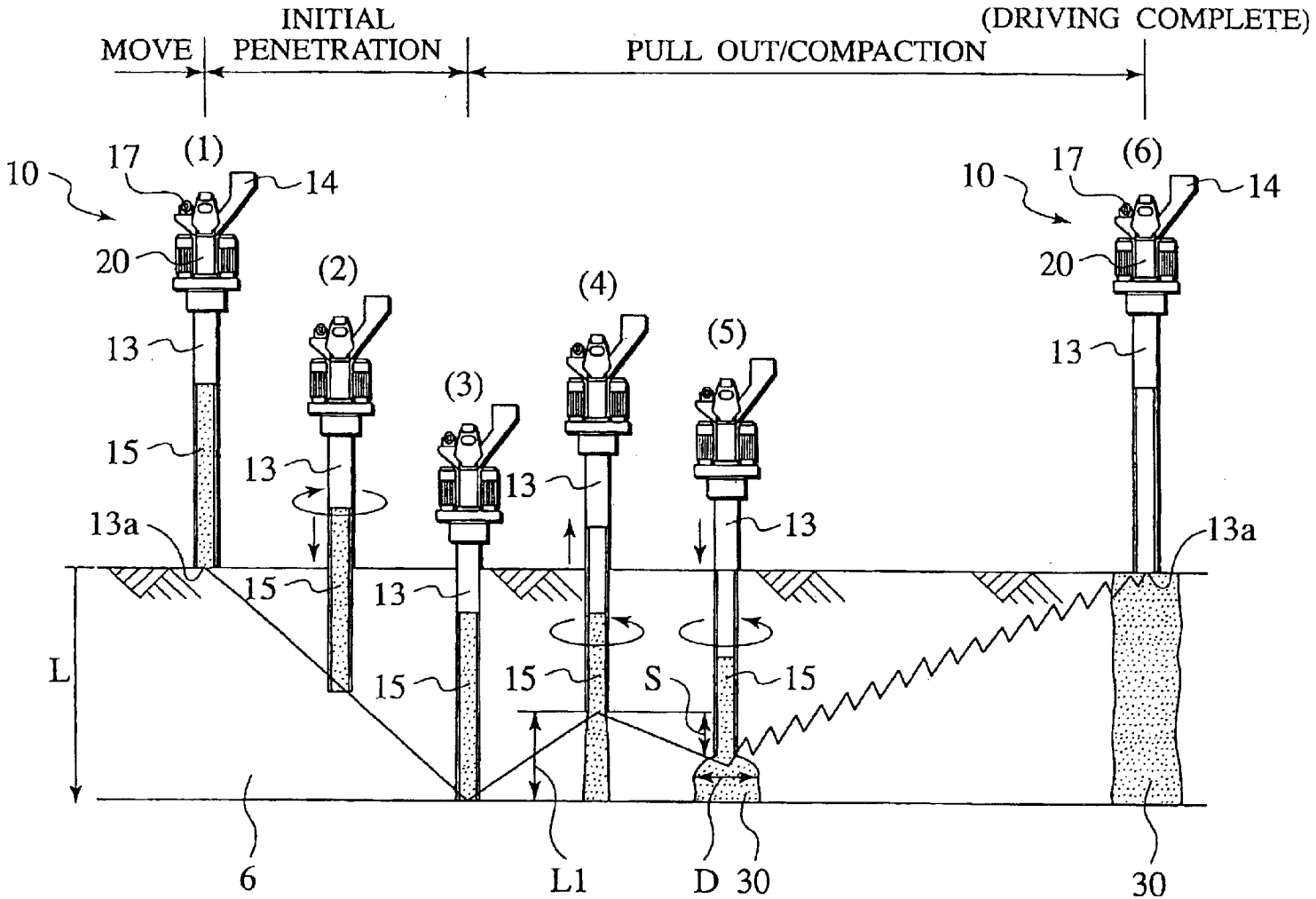
FIG. 7 is a sequence drawing showing a method of driving a sand pile according to the present invention.

An embodiment of the present invention will be explained based on the figures. FIGS. 3 to 7 show an embodiment of the present invention. FIG. 3 is a side view of a sand pile driving apparatus, FIG. 4A is a front view of a rotational mechanism, FIG. 4B is a cross-sectional view taken along line IVB—IVB in FIG. 4A, FIG. 5 is a block diagram of a main circuit of a control system of a sand pile driving apparatus, FIG. 6 is a flow chart on driving a sand pile, and FIG. 7 is a procedure drawing explaining a method of driving a sand pile.

As shown in FIG. 3, a sand pile driving apparatus 10 includes a leader 12 in front of the main construction unit 11. The leader 12 is disposed vertical above a ground 6. A casing pipe 13 (hollow pipe) being ascendable and descendable along a vertical direction is disposed to the leader 12.

The casing pipe 13 is cylindrical and a hopper 14 is provided on the upper end thereof. Granule sand 15 can be put into the casing pipe 13 from the hopper 14. A sand surface sensor 16 (shown only in FIG. 5) for detecting the position of the sand surface 15 accumulated in the casing pipe 13 (shown only in FIG. 7) is provided in the casing pipe 13. Note that a spiral blade can be attached on the outer side of the casing pipe 13. A cutting bit can also be attached at the lower end of the casing pipe 13.

An elevating mechanism 17 includes an unillustrated motor for elevating and an unillustrated power transmission means which transmits the rotating force of the motor to the casing pipe 13 and the elevating mechanism 17 ascends and descends the casing pipe 13 in the ground 6. Likewise, a hydraulic sensor 18 for detecting hydraulic pressure during the elevation of the casing pipe 13 is also provided to the elevating mechanism 17. In addition, a depthometer 19 for detecting the depth at the lower end of the casing pipe 13 is provided to the elevating mechanism 17.

A rotational mechanism 20 includes, as shown in FIGS. 4A and 4B, a pair of rotary motors 21 and 21 disposed on both sides of the rotational mechanism 20, first gear 22 fixed on the rotation axis of each motors 21, and a second gear 23 which engages with each of the first gears 22 fixed on the outer circumference of and concentric with the casing pipe 13 which rotates the casing pipe 13 in a given direction continuously. The rotational mechanism 20 also has a current sensor 24 for detecting driving current of the rotary motor 21. Note that the driving current can be detected directly by the current detection circuit included in a driving circuit of the rotary motor 21, or can be detected indirectly from a control circuit.

A swivel joint 25 is set on the casing pipe 13 at the lower part of the rotational mechanism 20, as shown in FIG. 4A. Through this swivel joint 25, an air pipe 26 is connected. On the other end of the air pipe 26, an unillustrated air compressor is connected so that compressed air can be supplied to the casing pipe 13 through the air pipe 26.

A description will be given on the control system of the sand pile driving apparatus 10. As shown in FIG. 5, detected outputs from the sand surface sensor 16, hydraulic sensor 18, depthometer 19, and current sensor 24 are inputted to the control unit 25 and the control unit 27, based on these information and the like, controls the elevating mechanism 17, rotational mechanism 20, and the air compressor and the like. Since the hydraulic pressure value detected by the hydraulic sensor 18 is proportional to the thrust force by which the lower end 13*a* of the casing pipe 13 presses the sand pile 30 (reaction force from the sand pile 30), the control unit 27 obtains a thrust force from the hydraulic pressure value of the hydraulic sensor by performing arithmetic. Since the current value detected by the current sensor 24 is proportional to the rotational load of the casing pipe 13, the control unit 27 can obtain a torque of the casing pipe 13 from the current value of the current sensor 24 by performing arithmetic.

Detected information and the like by the sensors are displayed by the control unit 27 on an instrument panel 28 which located at the driver's seat of the main construction unit 11. A driver can grasp and supervise the condition of the work for driving a sand pile by the instrument panel 28.

Note that in the following description of embodiments, the term sand 15 is used as an example of granular material for piling. However, the material for the pile is not limited to sand 15. Sand-like granular materials such as gravel, crushed stones, and the like, or a mixture of these materials including solidification material, sand 15, gravel and the like can be used instead of the sand. As an example a mixture of crushed stones and iron powder can be also used in the same way.

First Embodiment

Sand pile driving work with the sand pile driving apparatus 10 according to a first embodiment will be described based on a flow chart shown in FIG. 6 and an explanatory drawing shown in FIG. 7. As shown in the state (1) of FIG. 7, the sand pile driving apparatus 10 is moved to a desired height position for construction and sand 15 is put into the casing pipe 13 by the hopper 14 which is set at a standing position. As shown in the state (2) of FIG. 7, by driving the elevating mechanism 17 and the rotational mechanism 20, an initial penetration procedure in which the casing pipe 13 is rotatively descended into the ground 6 is started (Step S1). The depthometer 19 continuously monitors whether the lower end 13*a* of the casing pipe 13 reaches a predetermined depth of L (Step S2). In the state as depicted by (3) of FIG. 7, in a case where the lower end 13*a* of the casing pipe 13 reaches a predetermined depth of L, the initial penetration procedure is finished (Step S3).

As shown in the state (4) of FIG. 7, the inside of the casing pipe 13 is pressurized by compressed air and a pull out procedure for pulling out the casing pipe 13 by a predetermined length L1 is performed while discharging sand 15 from the lower end 13*a* of the casing pipe 13 (Step S4). Whether the casing pipe 13 is pulled out to the predetermined length L1 is continuously checked by the depthometer 19 (Step S5). Following confirmation of the sand surface made by a sand surface sensor after pulling out the casing pipe 13 by a predetermined length L1, the compressed air in the casing pipe 13 is released therefrom and the pull out procedure is finished (Step S6). By this pull out procedure, sand 15 is filled in a space created in the ground 6 after the casing pipe 13 is pulled out.

As shown in the state (5) of FIG. 7, a compaction procedure is started wherein the elevating mechanism 17 and the rotational mechanism 20 are driven and the casing pipe 13 is repenetrated by rotatively descending into the ground 6 (Step S7). In this compaction procedure, a stiffness condition of the pile compacted by the casing pipe 13 is estimated as a compaction condition $\phi$ (to be described later) which represents the strength of the pile and then checked whether a given condition $\phi_0$ has been satisfied or not (Step S8).

In principle, it is necessary that the strength of a pile reaches a predetermined value in the compaction procedure. It is important to estimate the strength of the pile as accurate as possible. Therefore, in order to evaluate the compaction condition of $\phi$ by quantity which reflects the pile strength, a parameter of compaction force F is adopted.

Since the thrust force P mainly relates to a compressive force in the altitudinal direction for the granule around the lower end portion of the casing pipe and, in addition, the driving torque T mainly reflects a compaction force (compressive force) which works in the lateral direction around the lower end of the casing pipe through a rotational movement, and the inventors have found that the strength (stiffness) of the pile can be more accurately estimated by assuming the compaction condition while taking the driving torque or both the driving torque and the thrust force into consideration. Along with the rotational movement of the casing pipe, the lower end portion thereof produces a compressive force in the lateral direction (a direction intersecting with the rotational axis) as a result of interaction between the lower end portion of the casing pipe and granule. The lower end portion of the casing pipe also changes a part of the compressive force working in the altitudinal direction and being produced by thrust force into the compressive force in the lateral direction. Therefore, for example, in a case where the thrust force P or the driving torque T is large, either the compressive force working in the altitudinal direction or the compressive force working in the lateral direction is large and the compaction of the pile is assumed to perform quickly. Therefore, the compaction force F is evaluated large and the compaction time must be set shorter.

According to the present invention, the compaction condition $\phi$ which reflects the strength of the pile is estimated based not only on thrust force P of the casing pipe 13 that presses the granule pile but also on the driving torque T for rotational motion of the casing pipe against the granule pile, and thereupon the pile is compacted so that the compaction condition reaches the given condition $\phi_0$. More specifically, the compaction force F, as a parameter for evaluating the compaction condition $\phi$, is estimated and compaction time is adjusted so that the compaction force F becomes a predetermined value $F_0$. Therefore, the compaction is completed at the point the compaction force F reaches the predetermined value $F_0$ by compaction. The predetermined value $F_0$ of the compaction force which corresponds to the given compaction condition $\phi_0$ is calculated from the construction data and the like in advance, and the value can be properly modified and set during the procedure of the compaction depending on the condition of compaction or condition of the ground around the pile. Note that the term of compaction force means a quantitative parameter that represents the compaction condition relating to the strength (stiffness) of a pile and will be used as an example for an estimated compaction condition in the following description.

Since the driving torque may contain information regarding thrust force inherently, the driving torque alone can be used as a component of compaction condition. The same can be applied to a case when trouble in detecting thrust force occurs. In such a case, the compaction condition can be estimated by allowing the driving torque T to represent information regarding thrust force P and driving torque T in the following description.

In the present invention, the term driving torque means a parameter that includes information regarding a true driving torque necessary for rotational motion of the casing pipe 13 against resisting force produced at the lower end of the casing pipe. Incidentally, it is easily understood by a person skilled in the art that the torque T can be calculated from hydraulic pressure when the hydraulic pressure is used for the rotational mechanism. In addition, the driving torque T is acquired from the driving current of the driving motor in the present embodiment. However, in the present invention, in a case where a resisting force produced at the lower end of the casing pipe can be estimated by a measurable physical value relating to rotational motion, such as rotational speed of the casing pipe instead of driving current, the estimated resisting force can be regarded as the driving torque.

After the compaction procedure, the aforementioned pull out procedure of the casing pipe 13 and the compaction procedure are repeated alternately. During the process of repeating these procedures, when the sand 15 in the casing pipe 13 is reduced, air is exhausted from the casing pipe 13 and sand 15 is supplied. Work is finished when the depth of the lower end 13*a* of the casing pipe 13 reaches zero, as shown in the state (6) of FIG. 7 (Step S12). As a result, a sand pile 30 which is compacted by a predetermined compaction force is created at the position where the casing pipe 13 was initially penetrated.

In the compaction procedure of the present embodiment, the casing pipe 13 is pressed downward while sand 15 is compacted by rotating the casing pipe 13, and the compaction condition is estimated based on the driving torque T for rotating the casing pipe 13 against the sand 13 or, on the torque T together with the thrust force P of the casing pipe 13 pressing the sand 15. That is, as described above, in the case the columnar shaped sand 15 is compacted, the sand 15 is compacted more certainly by loading thrust force P together with torque T, than only the thrust force P from the casing pipe 13. In addition, the thrust force P and the torque T can be easily estimated with an actual measurable value. Therefore a method to complete compaction when the presumed compaction condition $\phi$ based on the estimated thrust force P and torque T reaches a given condition $\phi_0$ is a suitable method for compaction procedure using pressure together with rotational motion.

In the sand pile driving method according to the present embodiment, especially in the sand pile driving method which includes a process of compacting a granule pile by pressing downward together with a rotational motion of the casing pipe, adequate compaction is naturally enabled by accurately estimating the pile strength from the driving torque and the thrust force which are measurable. Furthermore, it is unnecessary to add new mechanisms for estimating the pile strength to the sand pile driving apparatus, since estimating the torque T satisfies the requirements.

Second Embodiment

A second embodiment of the sand pile driving procedure by the sand pile driving apparatus 10 will be described based on FIGS. 6 and 7. Note that in this embodiment, the sand pile driving apparatus 10 shown in FIGS. 3 to 5 and the operations from the initial penetration procedure up to the pull out procedure (Steps S1 to S6) are the same as those of the first embodiment. Therefore, description of them will be omitted.

When the sand 15 fills a space created in the ground 6 after the casing pipe 13 is pulled out by the pull out procedure (Step S6), then, as shown in the state (5) of FIG. 7, a compaction procedure starts by repenetrating the casing pipe 13 which is rotatively descending by means of driving the elevating mechanism 17 and the rotational mechanism 20(Step S7). In this compaction procedure, compaction condition $\phi$ is estimated by the compaction force F of the casing pipe 13 which is defined by a later-described expression (1). Thereupon, depending on whether F is equal to or larger than the predetermined value $F_0$, whether the given condition $\phi_0$ is satisfied or not is checked (Step S8).

As described in the first embodiment, the compaction force F is a parameter representing the compaction condition $\phi_0$ which is obtained as a result of accumulating the compaction procedures at every moment from the start of compaction. In the present embodiment, the thrust force of the casing pipe 13 is represented by P, the driving torque for rotating the casing pipe 13 by T, compaction time by t, and coefficients obtained from construction data by $\alpha$ and $\beta$. Therefore, the compaction force F can be expressed by the following expression (1).

$$F=\alpha\cdot P\cdot T\cdot t+\beta \tag{1}$$

More specifically, the torque T is a parameter representing, of total torque of the casing pipe 13, effective driving torque necessary for rotational motion of the casing pipe 13 against the resisting force produced at the lower end portion of the casing pipe 13. The driving torque T can be expressed by a relationship of T=T1+T2, when the driving torque of the casing pipe 13 in the pull out procedure is T1 and the driving torque of the casing pipe 13 in the compaction procedure is T2. In this case, the parameter F can be calculated by the following expression (1')

$$F=\alpha\cdot P\cdot T2/T1\cdot t+\beta \tag{1'}$$

As long as the torque T is a parameter including information on effective torque necessary for rotational motion of the casing pipe 13 against the resisting force produced at the lower end portion of the casing pipe, other expressions can be adopted. Note that when the value of the thrust force P or the torque T fluctuates significantly during the compaction procedure, each changing time can be represented by P(t) and T(t) and the expression (1) can be replaced by the following expression (2).

$$F=\alpha\int^{t} P(\tau)T(\tau)d\tau+\beta \quad (2)$$

The thrust force P can be calculated by multiplying a given coefficient to the hydraulic pressure value of the hydraulic sensor 18 and torque T1 and T2 can be calculated by multiplying a given coefficient by the current value of the current sensor 24. Incidentally, it is easily understood by a person skilled in the art that when hydraulic pressure is used for the rotational mechanism, torque T1 and T2 can be calculated from the hydraulic pressure.

Following the compaction procedure, the aforementioned pull out procedure of the casing pipe 13 and compaction procedure is repeated alternately. During the procedure of this repetition, when the sand 15 in the casing pipe 13 is reduced, air in the casing pipe 13 is exhausted and sand 15 is supplied into the casing pipe 13. When the depth of the lower end 13*a* of the casing pipe 13 reaches zero, as shown in the state (6) of FIG. 7, the repetition is finished (Step S12). Then, a sand pile 30 which is compacted by a predetermined compaction force is driven at the position where the casing pipe 13 was initially penetrated.

In the compaction procedure of the present embodiment, the casing pipe 13 is pressed downward while sand 15 is compacted by rotating the casing pipe 13. The compaction force F as a parameter for controlling the compaction consists of at least the thrust force P which is the pressure of the casing pipe 13 pressing against the sand 15 and the driving torque T (=T2/T1) for driving rotational motion of the casing pipe 13 against the sand 13. That is, when compacting a columnar shape sand 15, adding the thrust force P and the torque T enables more accurate compaction than compacting by the thrust force P alone with the casing pipe 13. Therefore, in order to grasp the compaction condition of the sand 15, i.e., the strength of the sand 15, by regarding the external force as compaction force consisting of elements thrust force P and torque T, therefore, the compaction condition, i.e., strength of the sand pile 30 may be accurately estimated. As a result, the sand pile 30 with a desired strength can be driven. In addition, the thrust force P and the torque T can be easily calculated by measurable physical values without adding new mechanisms. Therefore, a method to complete the compaction at the point compaction force F presumed on the basis of the estimated thrust force P and torque T reaches a given value $F_0$ is a suitable method for a compaction procedure using both pressure and rotation.

In the present embodiment, with regard to the torque T as one of elements of the compaction force F, relative torque ratio (T2/T1) which is a ratio of torque in the adjacent pull out procedure and a torque in the following compaction procedure is used as the torque T. Therefore, the effective value of the torque T can be evaluated by excluding the friction resistance on the side surface of the casing pipe, which varies according to the variation in length of the casing pipe in the ground 6, from the total torque. Thus, the compaction condition, that is, the strength of the sand pile 30 can be grasped more exactly and, as a result, the sand pile 30 with a desired strength can be driven.

Third Embodiment

A second embodiment of the sand pile driving work by the sand pile driving apparatus 10 will be described based on FIGS. 7 to 9. Note that in this embodiment, the sand pile driving apparatus 10 shown in FIGS. 3 to 5 and the procedures from the initial penetration procedure up to the pull out procedure shown in FIG. 8 (Steps S1 to 6) are the same as those of the first embodiment. Therefore, description for them will be omitted.

When the sand 15 fills a space created in the ground 6 after the casing pipe 13 is pulled out by the pull out procedure (Step S6), then, as shown in the state (5) of FIG. 7, a compaction procedure stars by repenetrating the casing pipe 13 which is rotatively descending by means of driving the elevating mechanism 17 and the rotational mechanism 20 begins (Step S7). In this compaction procedure, whether or not the compaction force F by the casing pipe 13 is equal to or larger than the given preset value $F_0$ is checked (Step S18). Furthermore, when the compaction force F is equal to or larger than the preset value $F_0$, whether or not the diameter D of the sand pile becomes equal to or larger than the minimum value D1 (Step S9), and when the compaction force F is smaller than the preset value $F_0$, whether or not the diameter D of the sand pile reaches the maximum value D2 or not is checked (Step S10).

Meaning of each terms, compaction condition $\phi$, parameter F, thrust force P, torque T, is the same as that for the first embodiment. In the present embodiment, information regarding the diameter of the pile is added as a component of the compaction condition $\phi$ other than the parameter F including the thrust force or the torque. Steps S18, S9, and S10 are conditions of Step S8 in the first embodiment. Piles with a minimum diameter D1 and a maximum diameter D2 are driven to have a uniform diameter thereof. The diameter of the piles are determined by consulting the thrust force and prior bowling data for each layer of the ground and referring to past construction data. Furthermore, the difference $\Delta H$ in elevation between sand surface position H1 before adjacent pull out procedure and sand surface position H2 after finishing the pull out procedure can be detected by the sand surface sensor 16 in order to calculate the amount of sand Vs discharged into the ground 6. By use of the amount of compaction stroke S in the compaction procedure, sand pile diameter D can be estimated by a relationship of $Vs=\pi/4\cdot D^2(\Delta H-S)$.

Figure 9:
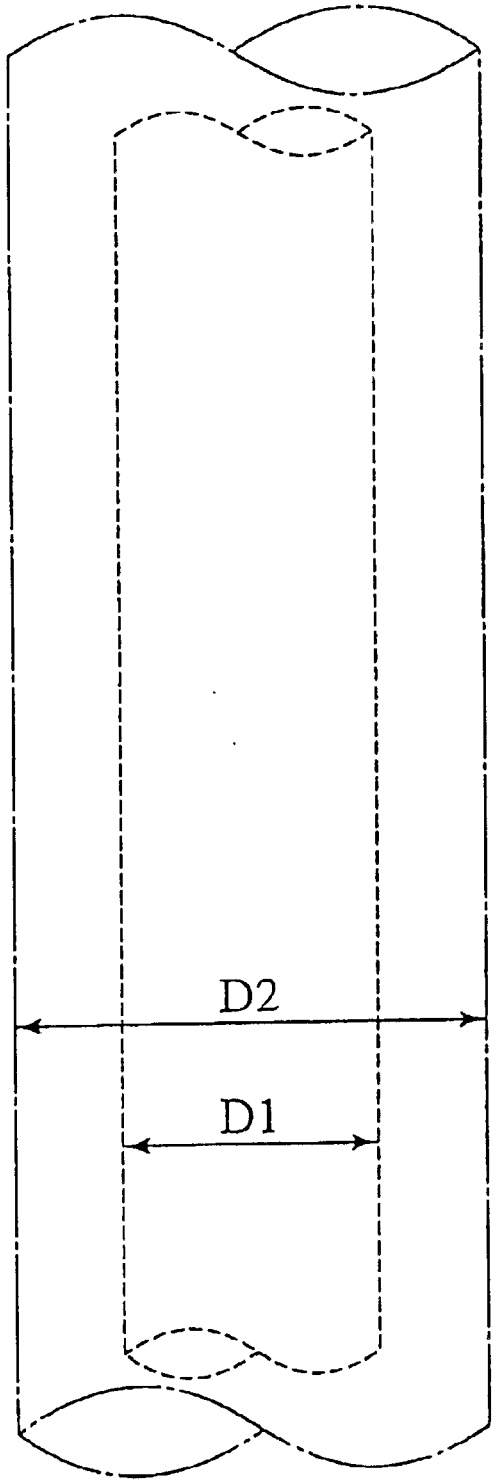
FIG. 9 shows minimum and maximum diameters of a pile to be driven by the sand pile driving method according to the present invention.
Figure 10:
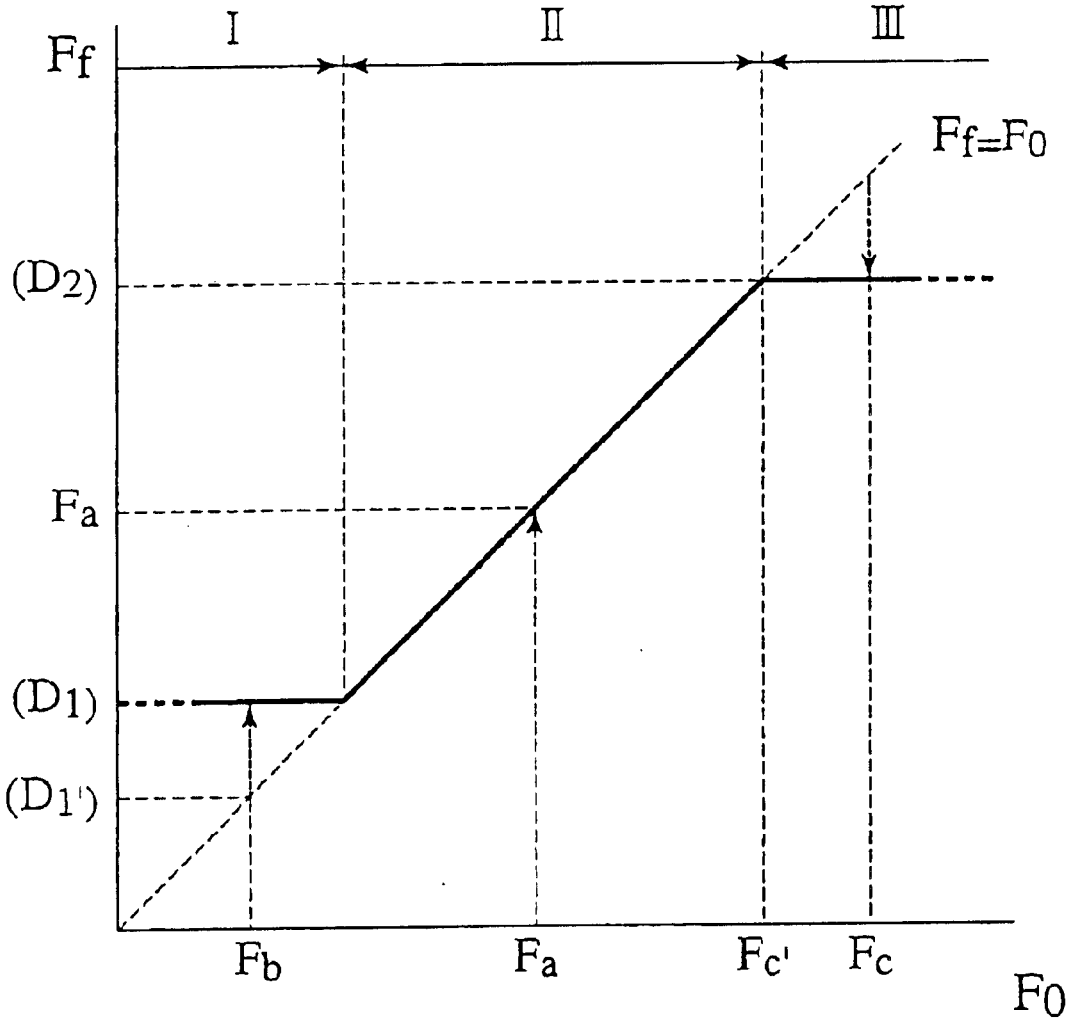
FIG. 10 shows a relationship between a parameter F and diameter of a pile in the driving of a sand pile according to the present invention.

Referring to FIGS. 9 and 10, compaction procedures in different cases will be described. In the present embodiment, given compaction condition $\phi_0$ will be set or changed based on conditions regarding the pile diameter D in the following three cases. Incidentally, in FIG. 10, the horizontal axis indicates the given compaction force $F_0$, which is set as a target for the time being (can be changed during the procedure), while the vertical axis indicates the real compaction force $F_f$ at the point the compaction is completed.

Case I: In the case the compaction force F reaches the given preset value $F_0(=F_b)$ before the diameter (cross-sectional area of pile) of the sand pile 30 reaches the minimum pile diameter (minimum cross-sectional area) D1 by compaction of the casing pipe 13 (D=D1'<D1), compaction will proceed and finish at the point when the diameter D of the sand pile 30 reaches the minimum pile diameter D1 (Step S11). In this case, the preset value $F_0(>F_b)$ is altered and set during the procedure.

Case II: In the case the compaction force F reaches the given preset value $F_0$(=Fa) before the pile diameter D of the sand pile 30 reaches the maximum pile diameter (maximum cross-sectional area of the pile) D2 by compaction procedure of the casing pipe 13, the compaction procedure is completed at the point when the compaction force F reaches the given preset value $F_0$ (Step S11).

Case III: In the case before the compaction force F reaches the given preset value $F_0$(=Fc), the pile diameter of the sand pile 30 reaches the maximum pile diameter D2 by compaction procedure of the casing pipe 13 (F=Fc'<Fc), the compaction procedure is completed at the point the pile diameter D of the sand pile 30 reaches the maximum pile diameter D2 (Step S11). In this case, the preset value $F_0$ is to have been altered and set during the procedure.

Afterwards, the aforementioned pull out procedure of the casing pipe 13 and the compaction procedure are repeated alternately. In the process of repeating these operations, at the point sand 15 in the casing pipe 13 is reduced, air is exhausted from the casing pipe 13 and sand 15 is supplied again. Then the repetition is finished when depth of the lower end 13*a* of the casing pipe 13 reaches zero, as shown in the state (6) of FIG. 7 (Step S12). As a result, a sand pile 30 which is compacted by compaction force is driven at the position where the casing pipe 13 was initially penetrated. A pile diameter D of the driven sand pile 30 is within a range of D1≦D≦D2.

According to the sand pile driving method of the present embodiment, in the case the actual ground 6 is of a very soft point, the pile diameter (cross-sectional area of the pile) of the sand pile 30 does not exceed the maximum pile diameter (maximum cross-sectional area) D2. Also, even if the compaction force F does not reach the given preset value, the sand pile 30 has a maximum pile diameter (maximum cross-sectional area) D2 and the bare minimum strength is maintained. Therefore, this enables to drive a sand pile 30 which does not cause trouble in terms of strength in the ground 6 being a very soft point, and the increase in total construction time or total amount of sand is limited as much as possible. In addition, in the case the ground 6 is of a very hard point, the pile diameter (cross-sectional area) D of the sand pile 30 will not be smaller than the minimum pile diameter (minimum cross-sectional area) D1 and therefore, a sand pile 30 with the minimum required diameter (cross-sectional area) will be driven.

Note that since the casing pipe 13 is cylindrical in the present embodiment, instead of the cross-sectional area of the sand pile 30, the diameter of the casing pipe 13 is used to determine whether the sand pile diameter D is equal to or larger than the minimum pile diameter D1, or whether the sand pile diameter D is equal to or larger than the maximum diameter D2. If the casing pipe 13 is of a shape other than a cylinder, the cross-sectional area is used to control the size of the sand pile 30. In a case where the casing pipe 13 of a shape other than a cylinder, rotating the casing pipe 13 accompanies difficulty. Therefore, compaction of the sand pile 30 is performed by the thrust force P alone, without rotating the casing pipe 13. In such a case, the compaction force F consists of only the thrust force P in which the torque T is not included as a component.

According to the present embodiment, even in the case the actual ground is of a very soft point, the cross-sectional area of the sand pile does not exceed the maximum cross-sectional area. Also even if the sand pile is not compacted by compaction force of the given preset value, since the sand pile has a maximum cross-sectional area, the bare minimum of strength is maintained. Therefore, this enables to drive a sand pile 30 which does not cause trouble in terms of strength in the ground 6 being a very soft point, and the increase in total construction time or total amount of sand is constrained to the utmost.

Fourth Embodiment

Figure 11:
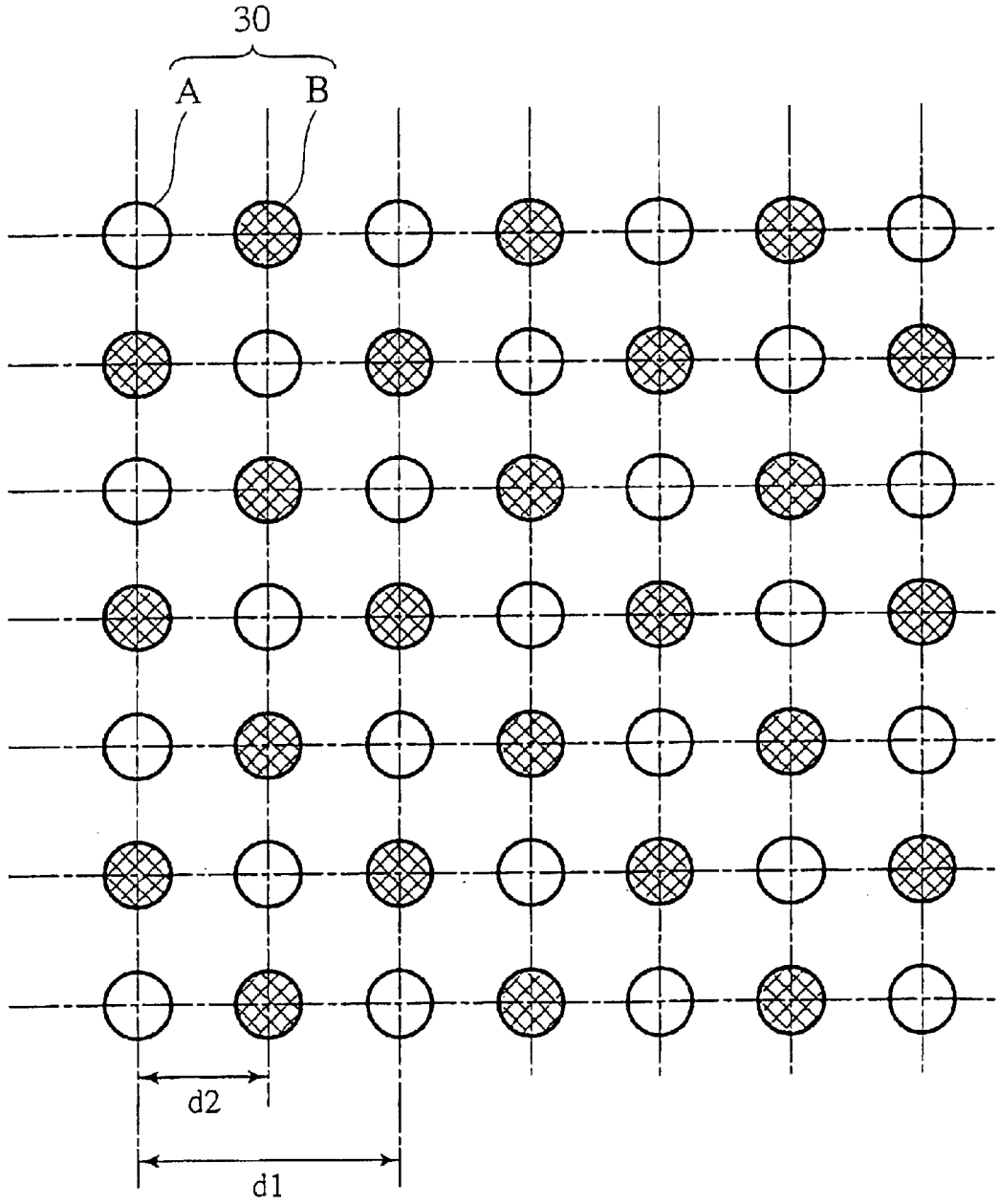
FIG. 11 shows the first and second driving stages, which are parts of an embodiment of the present invention.

According to the sand pile driving method of the present invention, it is possible to drive an appropriate pile corresponding to the strength of the actual ground, or even if the ground is soft. However, when the ground is extremely soft, there are cases when it becomes difficult to obtain a predetermined strength or a significant displacement is caused by localization of strength during a sand pile driving procedure, between an area where sand piles have already been driven and an area where the sand piles have not been yet. The sand pile driving method according to the present embodiment is composed of two steps, as shown in FIG. 11. The steps include a first step in which first sand piles A are driven within an area where the ground is to be improved with longer intervals (d1), and a second step in which second sand piles B are driven between the first sand piles A driven in the first step. As a result, in the example as shown in FIG. 11, the final interval between the piles 30 becomes d2. According to this driving method, the sand pile A to be driven in the first step need not always satisfy the given predetermined strength. The given predetermined strength is easily achieved by the sand piles B to be driven in the second step by the improvement of the ground strength around the sand piles A by compaction.

Figure 8:
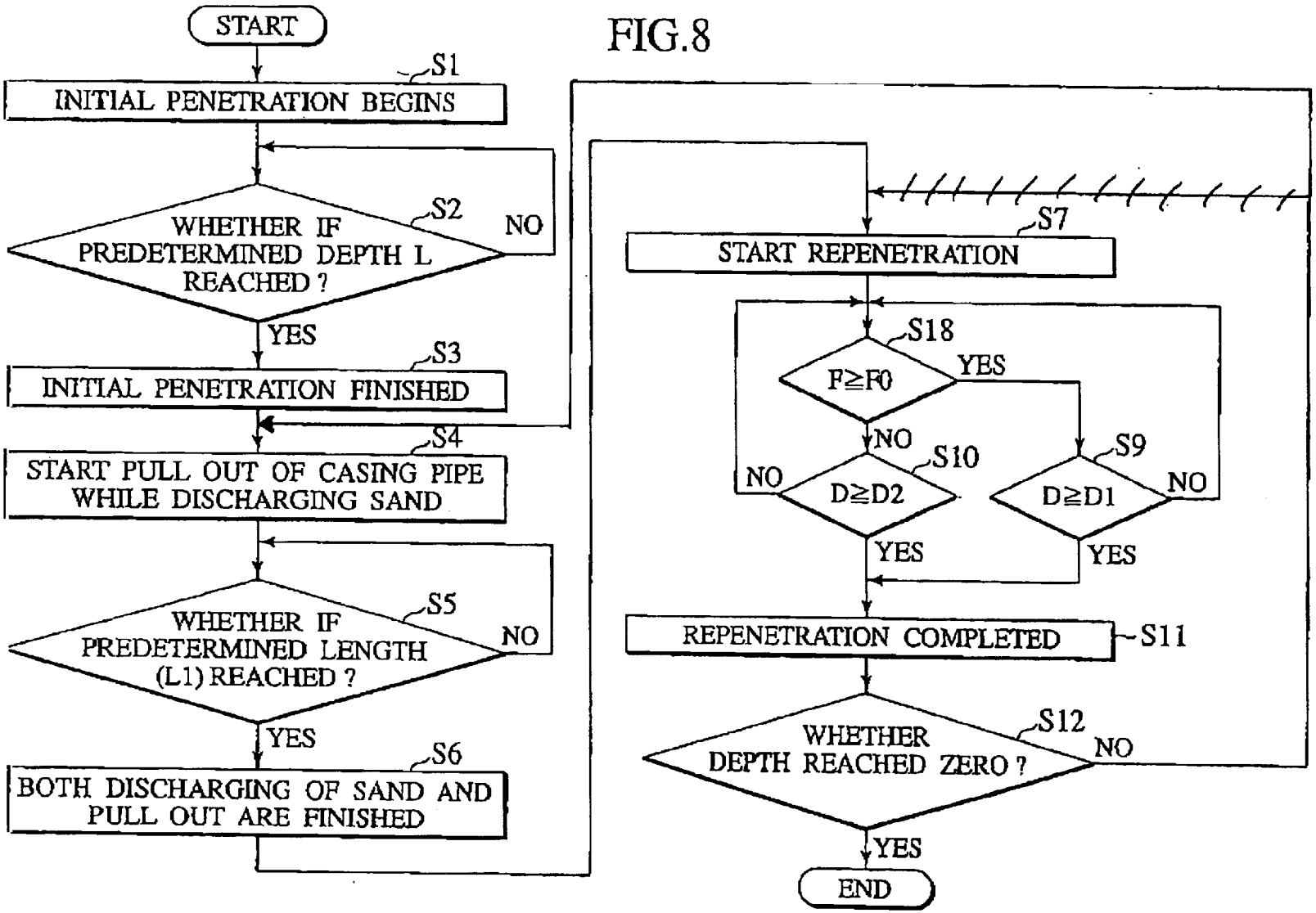
FIG. 8 is a flow chart in respect with driving a sand pile according to a second embodiment of the present invention.

Regarding the sand pile driving procedure of each of the sand piles A and B, the sand pile driving apparatus 10 shown in FIGS. 3 to 5 and procedures from the initial penetration up to pull out and compaction procedures shown in FIG. 7 to 8 are similar to those in the first embodiment. Hence, description thereof is omitted. Incidentally, it is not necessary to control the compaction time by estimating the compaction force from the thrust force and the torque during the pile driving compaction procedure.

The sand pile A to be driven in the first step does not necessarily need to satisfy the given predetermined strength as long as the strength of the sand pile A is secured to an extent the sand pile B to be driven in the second step satisfies the given predetermined strength. Therefore, in the first step, it is preferable that the sand pile driving procedure according to the first to third embodiments (especially the third embodiment) be selectively performed depending on the condition of the ground around each pile. In such a case, the compaction strength can be set smaller than the predetermined value. The ground where the first step has been completed can be regarded as the ground to be newly improved and in the second step a sand pile driving procedure from the first to third embodiments can be selectively performed for driving sand pile B. In addition, the second step may be configured by a plurality of driving steps. Furthermore, in the embodiment shown in FIG. 11, piles A and B are placed in a tetragonal lattice shape with a constant interval. However, disposition pattern of the piles A and B may be randomly set, including to a noncyclic pattern.

Furthermore, in a case where it is difficult to achieve a predetermined strength because of the existence of soft soil and the like, by performing the first step in the predetermined area, variation in the ground strength is reduced and the strength can be evenly improved and driving in the second step realizes the predetermined compaction. Since the ground is evenly strengthened in the first step, even if pile driving is in soft soil, binding of the ground is reinforced and, therefore, displacement of the piles can be constrained. In addition, in a method where vibration is applied to the piles by a vibrator and the like, displacement of the piles may occur to the previously driven piles due to driving of other piles. In a pile driving method of the present invention in which vibration does not occur, displacement of the piles by vibration does not occur. Therefore, the pile driving procedure according to the present embodiment suits the sand pile driving method by the other embodiments of the present invention by which enables to drive piles more accurately.

Fifth Embodiment

Figure 12:
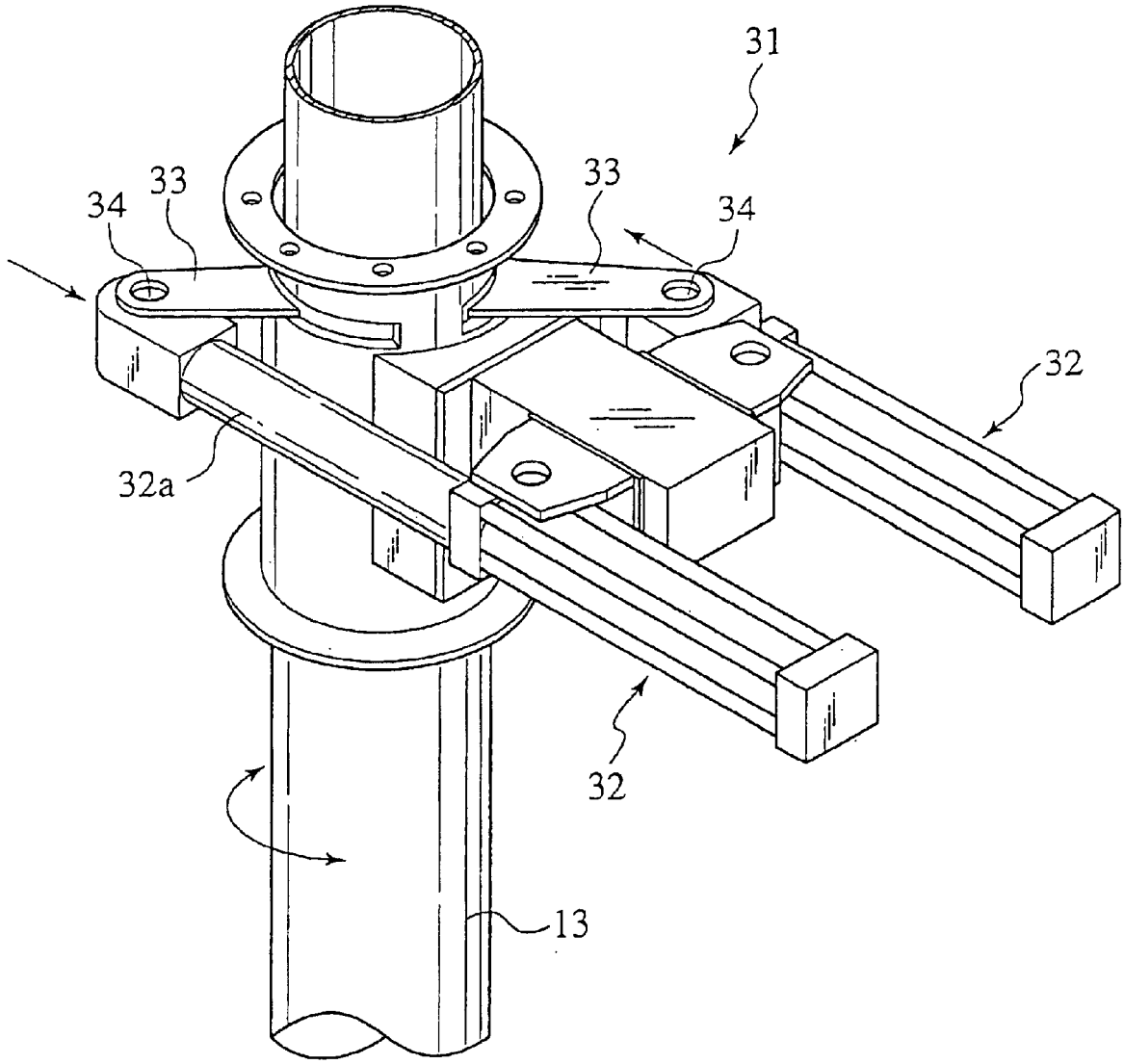
FIG. 12 is a perspective view showing a modified example of a rotational mechanism.

FIG. 12 is a perspective view showing a substantial portion of a modified example of a rotational mechanism.

The rotational mechanism 20 in the first to fourth embodiment was described to rotate the casing pipe 13 in a certain direction continuously. The rotational mechanism 31 of the present embodiment can alternatively rotate the casing pipe 13 clockwise and counterclockwise. As shown in FIG. 12, the rotational mechanism 31 includes a pair of hydraulic cylinder mechanism 32 and 32 and ends of piston rods 32*a* of this pair of hydraulic cylinder mechanism 32 and 32 are connected to each junction arms 33 through supporting pins 34. The junction arms 33 are provided substantially on the opposite sides of the periphery of the casing pipe 13 in a protruding condition.

When the pair of hydraulic cylinder 32 and 32 allow each of the piston rods 32*a* to perform piston motion alternately, the casing pipe 13 is rotated in the clockwise direction and the counterclockwise direction alternately.

The rotational mechanism 31 of the modified example for the compaction method of the present invention can be applied to other embodiments of the compaction method of the present invention instead of the rotational mechanism 20 and similar action and effects can be obtained therefrom. In comparison with the rotational mechanism 20 of the other embodiments, since the casing pipe 13 can be coupled with a air pipe and the like without intervening the swivel joint 25, as a whole, the mechanism of the sand pile driving apparatus 10 can be simplified.

This application claims benefit of priority under 35USC §119 to Japanese Patent Applications No. 2003-174400, filed on Jun. 19, 2003, and No. 2003-174402, filed on Jun. 19, 2003, the entire contents of which are incorporated by reference herein. Although the invention has been described above by reference to certain embodiments of the invention, the invention is not limited to the embodiments described above. Modifications and variations of the embodiments described above will occur to those skilled in the art, in light of the teachings. The scope of the invention is defined with reference to the following claims.

What is claimed is:

1. A sand pile driving method for driving a granule pile in a ground comprising a procedure of alternately performing a pull out procedure to pull out a casing pipe while discharging granule from a lower end portion of the casing pipe and a compaction procedure to compact a discharged granule by penetrating the casing pipe again, following an initial penetration procedure for penetrating the casing pipe to a predetermined depth in the ground, wherein:

the compaction procedure is for compacting the granule by rotational motion of the casing pipe and pressing the granule downward thereby; and at least a compaction time is controlled based on a driving torque for rotational motion of the casing pipe against the granule.

2. The sand pile driving method according to claim 1, wherein the compaction time of the compaction procedure is further controlled based on a thrust force of the casing pipe for pressing the granule.

3. A sand pile driving method for driving a granule pile in a ground comprising a procedure of alternately performing a pull out procedure to pull out a casing pipe while discharging granule from a lower end portion of the casing pipe and a compaction procedure to compact a discharged granule by penetrating the casing pipe again, following an initial penetration procedure for penetrating the casing pipe to a predetermined depth in the ground, wherein:

the compaction procedure is for compacting the granule by rotational motion of the casing pipe and pressing the granule downward thereby; and the compaction procedure is completed at a point in a case where a compaction condition satisfies a given condition, the compaction condition being estimated by a thrust force of the casing pipe for pressing the granule pile and a driving torque for rotational motion of the casing pipe against the granule pile.

4. The sand pile driving method according to claim 3, wherein the driving torque is estimated based on a driving torque of the casing pipe in the pull out procedure and on a driving torque of the casing pipe in the compaction procedure.

5. The sand pile driving method according to claim 3, wherein the compaction condition is estimated by an expression $$F=\alpha\cdot P\cdot(T2/T1)\cdot t+\beta,$$

where F is a compaction force, P is the thrust force of the casing pipe, T1 is the driving torque of the casing pipe in the pull out procedure, T2 is the driving torque of the casing pipe in the compaction procedure, t is a compaction time, and $\alpha$ and $\beta$ are coefficients acquired from construction data.

6. The sand pile driving method according to claim 1, wherein the compaction time for the compaction procedure is controlled based on a cross-sectional area of a pile.

7. A sand pile driving method for driving a granule pile in a ground comprising:

alternately performing a pull out procedure to pull out a casing pipe while discharging granule from a lower end portion of the casing pipe and a compaction procedure to compact a discharged granule by penetrating the casing pipe again, following an initial penetration procedure for penetrating the casing pipe to a predetermined depth in the ground, wherein a compaction condition for compacting granule by the casing pipe and a cross-sectional area of the granule pile compacted by the casing pipe are estimated during the compaction procedure; and wherein a compaction is completed:

(i) at a point that the pile cross-section area reaches a minimum cross-section area in a case where the compaction condition reaches a given state before the pile cross-section area reaches the minimum pile cross-section area;

(ii) at a point that the compaction condition reaches the given state in a case where the compaction condition reaches the given state before the pile cross-section area reaches a maximum pile cross-section area; or (iii) at a point that the pile cross-section area reaches the maximum cross-section area in a case where the pile cross-section area of the granule pile compacted by the casing pipe reaches the maximum pile cross-section area before the compaction condition reaches the given state.

8. The sand pile driving method according to claim 7, wherein the granule pile is compacted by pressing the granule pile downward by the casing pipe and a rotational motion thereof; and the compaction condition is estimated by at least a thrust force of the casing pipe pressing the granule pile and a torque for rotational motion of the casing pipe against the granule pile.

9. The sand pile driving method according to claim 7, wherein the granule pile is compacted by pressing the granule pile downward by the casing pipe and a rotational motion thereof; and the compaction condition is estimated by an expression $$F=\alpha\cdot P\cdot(T2/T1)\cdot t+\beta,$$

where F is a compaction force, P is the thrust force of the casing pipe, T1 is a torque of the casing pipe in the pull out procedure, T2 is a torque of the casing pipe in the compaction procedure, t is a compaction time, and $\alpha$ and $\beta$ are coefficients acquired from construction data.

10. A sand pile driving method for driving a granule pile in a ground comprising:

alternately performing a pull out procedure to pull out a casing pipe while discharging granule from a lower end portion of the casing pipe and a compaction procedure to compact a discharged granule by penetrating the casing pipe again, following an initial penetration procedure for penetrating the casing pipe to a predetermined depth in the ground, wherein the compaction procedure for compacting the granule pile is carried out by a rotational motion of the casing pipe and pressing the granule pile downward thereby; and wherein the method includes a first step for driving a plurality of first piles in a given area; and a second step for additionally driving a plurality of second piles between the previously driven first piles within the area in which each compaction is completed when a compaction condition reaches a given state.

11. A sand pile driving method for driving a granule pile in a ground comprising:

alternately performing a pull out procedure to pull out a casing pipe while discharging granule from a lower end portion of the casing pipe and a compaction procedure to compact a discharged granule by penetrating the casing pipe again, following an initial penetration procedure for penetrating the casing pipe to a predetermined depth in the ground, wherein the compaction procedure for compacting the granule pile is carried out by a rotational motion of the casing pipe and pressing the granule pile downward thereby; and wherein the method includes:

a first step for driving a plurality of first piles in a given area; and a second step for additionally driving a plurality of second piles between the previously driven first piles within the area, wherein a compaction time is arranged based on a driving torque for the rotational motion of the casing pipe against the granule pile in the compaction procedure in making at least one of the plurality of the first piles.

12. A sand pile driving method for driving a granule pile in a ground comprising:

alternately performing a pull out procedure to pull out a casing pipe while discharging granule from a lower end portion of the casing pipe and a compaction procedure to compact a discharged granule by penetrating the casing pipe again, following an initial penetration procedure for penetrating the casing pipe to a predetermined depth in the ground, wherein the compaction procedure for compacting the granule pile is carried out by a rotational motion of the casing pipe and pressing the granule pile downward thereby; and wherein the method includes:

a first step for driving a plurality of first piles in a given area; and a second step for additionally driving a plurality of second piles between the previously driven first piles within the area, wherein a compaction time is arranged based on a driving torque for the rotational motion of the casing pipe against the granule pile in the compaction procedure in making at least one of the plurality of the second piles.

13. The sand pile driving method according to claim 2, wherein the compaction time for the compaction procedure is controlled based on a cross-sectional area of a pile.

* * * * *